United States Patent [19]

Brunet

[11] Patent Number: 4,572,410

[45] Date of Patent: Feb. 25, 1986

[54] SAFETY ACTUATOR FOR AN AEROSOL VALVE

[75] Inventor: Michel Brunet, Ste Colombe la Commanderie, France

[73] Assignee: Etablissements Valois, Le Neubourg, France

[21] Appl. No.: 581,622

[22] Filed: Feb. 21, 1984

[30] Foreign Application Priority Data

Feb. 25, 1983 [FR] France ..... 8303077

[51] Int. Cl.[4] ..... B65D 83/06

[52] U.S. Cl. ..... 222/402.11; 222/402.1

[58] Field of Search ..... 222/153, 402.1, 402.11, 222/402.24, 182

[56] References Cited

U.S. PATENT DOCUMENTS

| | | | |
|---|---|---|---|
| 2,752,066 | 6/1956 | Ayres | 222/41 |
| 3,484,023 | 12/1969 | Meshberg | 222/402.11 |
| 3,632,024 | 1/1972 | Usen | 222/402.11 |
| 3,848,778 | 11/1974 | Meshberg | 222/402.11 |
| 4,071,173 | 1/1978 | Horan | 222/321 |
| 4,324,351 | 4/1982 | Meshberg | 222/402.11 |

*Primary Examiner*—Joseph J. Rolla
*Assistant Examiner*—Michael S. Huppert
*Attorney, Agent, or Firm*—Sughrue, Mion, Zinn, Macpeak and Seas

[57] ABSTRACT

A push button (2) is slidably and rotatably mounted in a sleeve (1). The push button is fitted to the valve-operating rod (28) of an aerosol valve (25) fitted in the opening of an aerosol can (26) by means of a dish (22). The inside edge of the dish is crimped to the valve and its outside edge is crimped to the edges of the can. The sleeve has an internal collar (3) which is snap fitted over the neck where the inside edge of the dish is crimped to the valve. Since the sleeve thus engages the valve rather than the can, sleeve size and shape is independent of the size and shape of the can (in so far as there are relatively few valve sizes used in a wide range of can shapes and sizes). Further, by crimping the neck (22*c*) so that its periphery is polygonal, the sleeve can be prevented from rotating. A safety push button requiring both a turning action and an axial displacement for operation, can thus readily be operated with one hand since there is no need to use the other hand to stop the sleeve from rotating.

5 Claims, 6 Drawing Figures

SAFETY ACTUATOR FOR AN AEROSOL VALVE

The present invention relates to a safety actuator for an aerosol valve. Such a safety actuator can be used, for example, for aerosols intended for keeping in a pocket, a handbag or a suitcase, such as traveller's perfume spray or a self defense gas spray. In this kind of application, it is important to avoid unintended operation which could damage adjacent objects or clothes, or else the bag or case itself.

BACKGROUND OF THE INVENTION

Safety push buttons of this type are described, for example, in U.S. Pat. Nos. 3,484,023 and 3,848,778 in the name of Philip Meshberg. These safety actuators include a push button having a jet orifice and fitted over the rod of a valve mounted in the opening to the container. They also include a sleeve having means for permanently fixing the actuator to the container. When in an "active" orientation, the push button is axially slidable inside the sleeve to open the valve and thus cause liquid contained inside the container to be expelled. The push button is also rotatable from said active orientation to an "inactive" orientation in which it is prevented from moving axially, thereby preventing the valve from being released.

These actuators, and other similar actuators, suffer from various drawbacks: Before use the push button must be rotated relative to the sleeve, but since the sleeve is not locked and may rotate with the actuator, the user needs to use both hands to be sure of unlocking the actuator. This is not desirable for self-defense aerosols that project tear-gas or the like. In case of need the aerosol must be instantly available, and it is highly advantageous for it to be useable singlehanded. The way in which the sleeve is fixed to the can as described in the above-mentioned U.S. patents is not suitable for preventing rotation. Furthermore, a different size of push button must be designed for each size of can.

Preferred embodiments of the present invention avoid the above drawbacks.

SUMMARY OF THE INVENTION

The present invention provides a safety actuator for an aerosol valve for mounting in the opening of an aerosol container by means of an intermediate metal fitting having a central portion crimped to the valve and a peripheral portion crimped to the edge of the opening to the container, said actuator comprising a cylindrical sleeve and a push button having a jet orifice and intended for fitting over the valve-operating rod of the valve and for turning and sliding inside the cylindrical sleeve, the improvement wherein the cylindrical sleeve includes an internal collar for snap fitting to the point where said intermediate fitting is crimped to the valve.

The fitting is usually a capsule or a dish made from a suitable washer. The crimping between the metal fitting and the valve must necessarily be of smaller diameter than the crimping between the fitting and the opening to the container. Higher friction must thus be provided between the sleeve and the fitting than would be necessary if the sleeve were fitted to the outside edge of the fitting or to the surrounding aerosol container. However, because of the small size of the crimping round the valve, it can readily be made polygonal in shape. It is thus possible to provide positive locking against rotation of the sleeve relative to the container.

The size of the sleeve is determined by the size of the crimping, ie. by the size of the valve. It is thus independent of the size of the container (or can).

BREIF DESCRIPTION OF THE DRAWINGS

An embodiment of the invention is described by way of example with reference to the accompanying drawings, in which.

Figure 5:
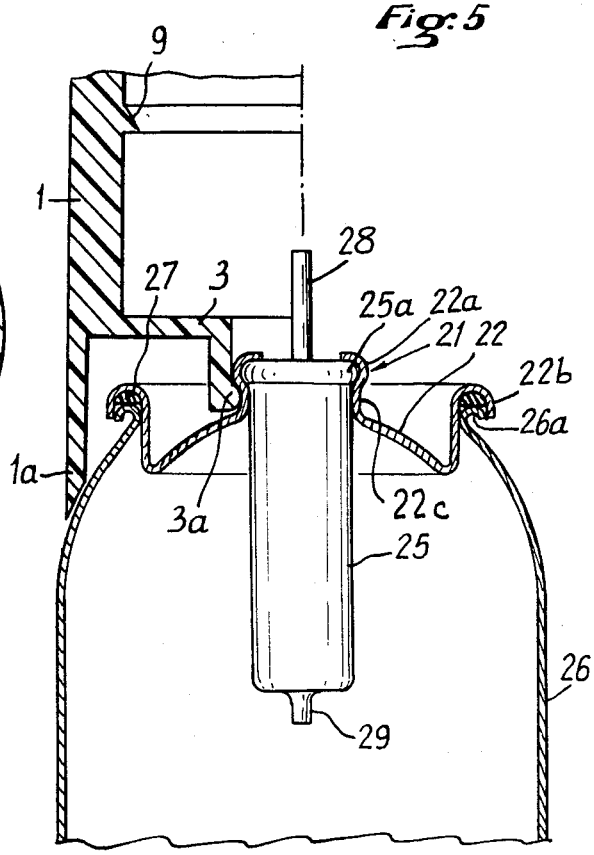
Figure 6:
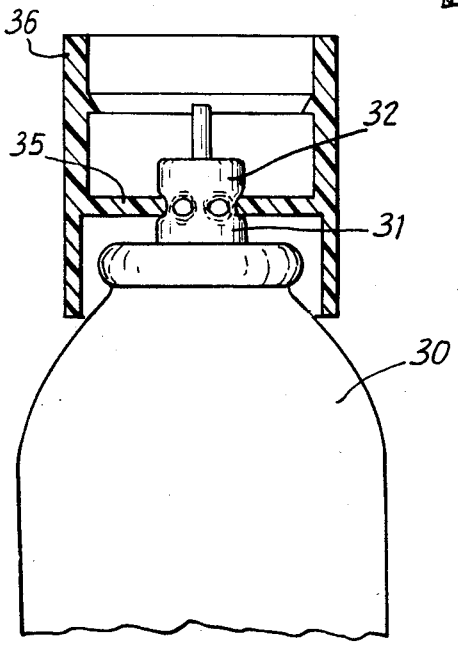

FIG. 5 is an axial section through the top of an aerosol can on which a valve is mounted by means of a dish which is crimped both to the valve and to the can, together with a portion of an actuator in accordance with the invention; and FIG. 6 is a side view of the top of an aerosol can on which a valve is mounted by means of a capsule, together with a portion of an actuator in accordance with the invention shown in axial section.

MORE DETAILED DESCRIPTION

The sleeve 1 is essentially cylindrical in shape. At a suitable level it includes an internal collar 3 for fixing to the turret 21 at the top of an aerosol valve of conventional and well-known shape and structure. The turret 21 is the central projecting portion of a dish 22 which is crimped to the valve body 25. The outside or top end of the valve has a circular lip **25*a* for the purpose of making up the turret 21. The dish 22 is made from a washer: its central portion 22*a* is crimped around the lip 25*a* of the valve, while its outer portion 22*b* is crimped to the edge 26*a* of the opening to the can 26, with a sealing ring 27 being interposed between the can and the dish. The valve usually includes a valve-operating rod 28 and an end piece 29** for connection to a dip tube. Such a valve assembly on an aerosol can is conventional.

The terms "up" and "down" as used herein relate to the orientation shown in the drawings, which is also the orientation in which the aerosol should be held during use. The sleeve 1 and the push button 2 are thus located at the top of the can and are held in place by the above-mentioned collar 3.

The button 2 has a jet orifice 4 and is conventionally mounted on the tubular top end of the valve-operating rod 28. The outside diameter of the button 2 is an easy sliding fit inside the inside diameter of the sleeve 1. The button is slidable between determined limit positions. The top edge of the sleeve has two cutouts. A first cutout 6 is provided as a window for the jet orifice 4 when the button 2 is located at predetermined depth and orientation inside the sleeve. The depth is determined either by the bottom of the button engaging the collar 3, or else by other means described below. To prevent the button from accidentally leaving the sleeve, the bottom of the button has an outwardly directed rib 8 which engages an inwardly directed rib 9 on the inside of the sleeve and at a distance above the collar 3. The ribs 8 and 9 may be chamfered in such a manner as to enable the button to be inserted into the sleeve by being thrust downwardly, with a snap locking action as the ribs 8 and 9 pass each other. Other arrangements could be devised, eg. one of the ribs could be replaced by a groove for receiving the other rib, or one or both of the ribs could be in the form of discontinuous segments.

The orientation of the button is fixed by an outwardly projecting key 11 extending along a generator line of the button 2, and engaging a second cutout 12 in the wall of the sleeve 1. There is an angle $\alpha$ between the radius through the jet orifice and the radius through the key 11. The angle between the radius passing through the middle of the first cutout 6 and the middle of the second cutout 12 is also equal to $\alpha$. The bottom most part 12*a* of the cutout 12 and the collar 3 are disposed low enough to enable the key 11 to be pressed down far enough for the valve to be operated by the push button. In conventional manner the valve includes a return spring which urges the button 2 upwardly. The upper portion 13 of the second cutout 12 is wider than the key 11, thereby enabling the key 11 and thus the entire push button 2 to be rotated, with the bottom edge of the key 11 sliding along the bottom edge 13*a* of the broader upper portion 13.

In the embodiment shown, the key 11 extends along the entire length of the push button 2. While this arrangement facilitates turning the button about its axis, it will be appreciated that the key 11 could be shorter, and need not reach one or either end of the button. The levels 12*a* and 13*a* at the bottoms of the narrow portion and the broad portion 13 of the second cutout 12 are chosen as a function of the length of the key used. The ribs 8 and 9 are at levels which are chosen so that they engage each other when the bottom edge 11*a* of the key 11 is on the bottom edge 13*a* of the broader portion 13 of the second cutout 12. The button is thus held captive against rising any further and escaping from the sleeve 1, but remains free to be pushed down further, provided it is turned to align the key 11 with the deeper portion of the cutout 12. The limit of downward travel may be determined by the bottom of the button engaging the collar 3, by the bottom of the key 11 engaging the edge 12*a* or else by the valve-operating rod 28 abutting against its own end stop. In order to prevent the key from catching on adjacent objects in a pocket, handbag or suitcase, the radial extent of the key 11 should be equal to or less than the wall thickness of the sleeve. It is thus prevented from sticking out sideways. To facilitate operation, the outside face of the key may be grooved, knurled or otherwise roughened, Finally, in order to improve engagement of a finger on the key, the second cut out is flanked on either side of its broader portion 13 by cutbacks 15 and 16 leaving portions of reduced sleeve wall thickness 15*a* and 16*a*.

Figure 1:
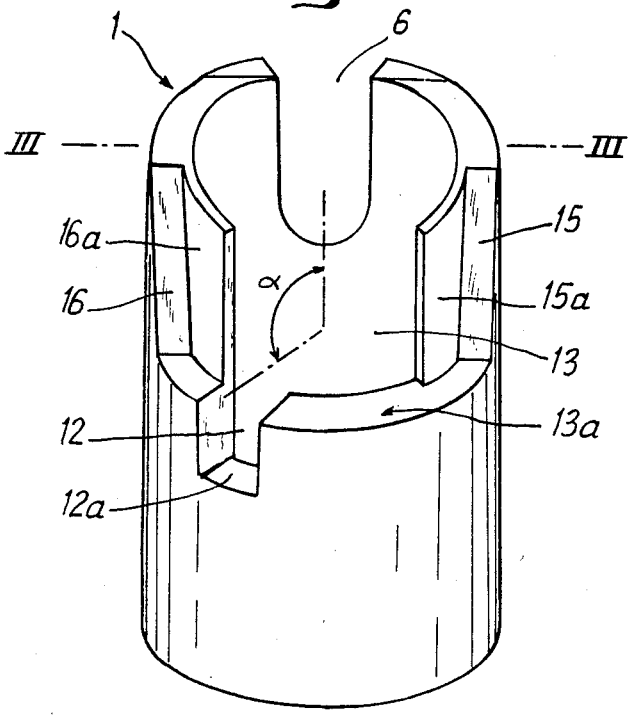
FIGS. 1 and 2 are perspective views of each of the major components of an actuator in accordance with the invention.
Figure 2:
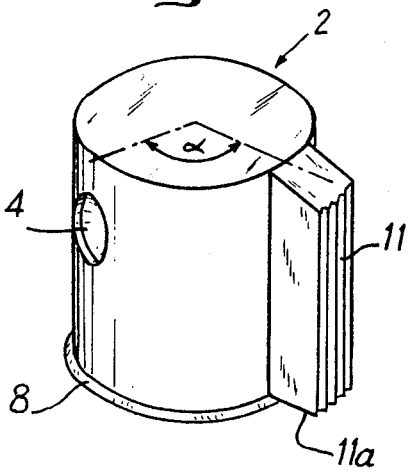
Figure 3:
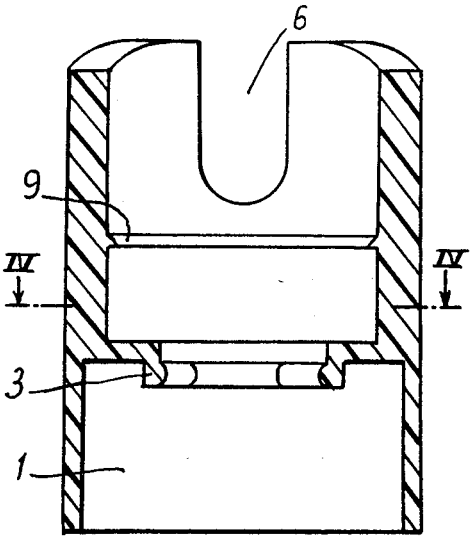
FIG. 3 is a section on an axial plane marked by a line III—III in FIG. 1.
Figure 4:
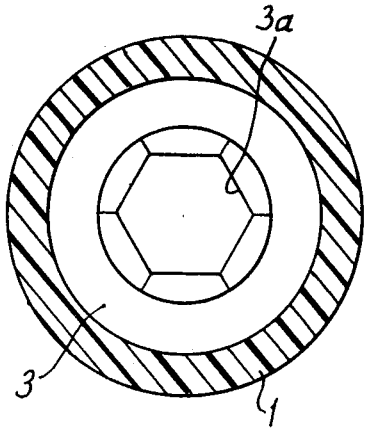
FIG. 4 is a cross section on a line IV—IV in FIG. 3.

The throat 3*a* of the collar 3 delimits a polygonal opening of identical perimeter to the neck 22*c* where the inside edge 22*a* of the dish is crimped just below the lip 25*a* of the valve 25. This generally small diameter crimp can readily be hexagonally shaped as shown in FIG. 4; this provides excellent locking against rotation.

The actuator is used as follows. The sleeve is fitted over turret 21 of the dish 22 on an aerosol valve mounted on a can. The button 2 is aligned with the sleeve with its key 11 ready to engage the broad portion 13 of the second cutout 12. The button 2 is then pushed home until its end surface 11*a* engages the edge 13*a* of the broad portion 13 and causing the rib 8 to snap past the rib 9 and occupy a position below it. The actuator is now ready for use, but in its safety position. The bottom of the key 11 abuts against the edge 13*a* and the jet orifice 4 is masked by the sleeve wall. By applying a finger to the outside surface of the key 11 (which is made easier by the cutback 15), the key 11 may be rotated until it is in line with the deep portion of the second cutout 12. The sleeve itself is prevented from rotating with the push button 2 because of the hexagonal fit between the throat 3*a* of the collar 3 and the neck 22*c* of the crimping. The jet orifice 4 is thus brought into its "window" 6. The button 2 may now be pushed down to cause the valve to operate. After operation the key 11 is pushed back to the locked or safety position by turning it in the opposite direction (which is made easier by the cutback 16). The user holds the body of the can in the hand, turns the button with the thumb, and presses the button with a finger. Since the sleeve is locked against rotation on the turret 21 of the dish, this movement is easily performed without any risk of the sleeve rotating together with the button.

FIG. 5 is a detailed cross section of the sleeve 1 assembled via the throat 3*a* in its collar 3 engaging in the neck 22*c* of the crimping. The throat size matches the valve size, and in particular the outside diameter of the valve and the inside diameter of the throat are chosen to match. The bottom 1*a* of the sleeve 1 is located close to the end wall of the aerosol can 26. It can be seen that the fixing arrangement of the present invention is capable of enabling a single size of sleeve/pushbutton assembly to be mounted on aerosol cans of different sizes. The requirement is for the valve 25 to be used in conjunction with a dish that fits the can.

FIG. 6 shows the top of a can 30 having a valve fitted in its opening by means of a capsule 31. The capsule turret 32 is crimped to the valve by hexagonal crimping which also serves to engage the throat of the collar 35 in a sleeve 36. Since a capsule projects clear from the top of the can, the collar 35 can be entirely flat without any need for a downwardly directed skirt to engage in the neck of the dish. For example, capsules of this type can be used to mount valves of 10 mm to 12 mm diameter in can openings of 14 mm to 21 mm diameter. The inside diameter of the sleeve 36 could then be 22 mm, which corresponds to the outside diameter of the push button. This demonstrates how a single size of sleeve/-pushbutton assembly can be used over a range of sizes of can openings.

I claim:

1. An aerosol dispenser, comprising:

(a) a cylindrical container (26) for holding a fluid to be dispensed under pressure, (b) a centrally apertured metal dish (22) having an outer peripheral portion (22*b*) sealingly crimped to an edge (26*a*) of the container defining an opening at an upper end thereof, (c) a valve body (25) disposed in the dish aperture with an inner peripheral portion (22*a*) of the dish being sealingly crimped to the valve body to define therewith an upstanding turret (21) having a polygonal cross-section, (d) a cylindrical safety sleeve (1) having an internal collar (3) defining a polygonal central aperture (3*a*) configured to closely mate with the turret cross-section, said collar aperture being snap fitted over the turret to mount the sleeve on the container in a non-rotatable manner, and (e) a cylindrical push button (2) rotatably and slidably mounted within the non-rotatable sleeve, said push button fitting over a hollow actuating rod (28) upstanding from the valve body and having a jet discharge orifice (4) communicating with an upper end of the rod.

2. A dispenser according to claim 1, wherein a bottom peripheral edge of the push button has an outwardly extending rib (8), and an inside face of the sleeve has catch means (9) cooperable with the rib to prevent the push button from being withdrawn axially from the sleeve.

3. A dispenser according to claim 2, wherein the push button includes a laterally projecting key portion (11) for facilitating the rotation of the push button, said key portion being received in a cutout (12) in a wall of the sleeve, and wherein walls (15*a*, 16*a*) of the sleeve flanking the cutout are of reduced thickness to provide cutbacks (15, 16) for facilitating the rotation of said key portion of the push button.

4. A dispenser according to claim 1, wherein the push button includes a laterally projecting key portion (11) for facilitating the rotation of the push button, said key portion being received in a cutout (12) in a wall of the sleeve, and wherein walls (15*a*, 16*a*) of the sleeve flanking the cutout are of reduced thickness to provide cutbacks (15, 16) for facilitating the rotation of said key portion of the push button.

5. A dispenser according to claim 1, wherein the turret cross-section and collar aperture are hexagonal.

* * * * *